US011920094B2

(12) United States Patent
Derks

(10) Patent No.: US 11,920,094 B2
(45) Date of Patent: Mar. 5, 2024

(54) METHOD OF PRETREATING AND CONVERTING HYDROCARBONS

(71) Applicant: SHELL OIL COMPANY, Houston, TX (US)

(72) Inventor: Willem Derks, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 16/467,294

(22) PCT Filed: Dec. 7, 2017

(86) PCT No.: PCT/EP2017/081817
§ 371 (c)(1),
(2) Date: Jun. 6, 2019

(87) PCT Pub. No.: WO2018/104443
PCT Pub. Date: Jun. 14, 2018

(65) Prior Publication Data

US 2020/0080009 A1 Mar. 12, 2020

Related U.S. Application Data

(60) Provisional application No. 62/431,458, filed on Dec. 8, 2016.

(51) Int. Cl.
*C10G 1/10* (2006.01)
*C10G 1/00* (2006.01)
(Continued)

(52) U.S. Cl.
CPC ..... *C10G 55/04* (2013.01); *C10G 1/002* (2013.01); *C10G 1/10* (2013.01); *C10G 21/14* (2013.01);
(Continued)

(58) Field of Classification Search
CPC ..... C10G 1/10
See application file for complete search history.

(56) References Cited

U.S. PATENT DOCUMENTS 2,600,184 A 6/1952 Arnold et al.
3,864,245 A 2/1975 Van Tassell
(Continued)

FOREIGN PATENT DOCUMENTS

CA 1246483 A 12/1988
CA 2214305 A1 2/1999
(Continued)

OTHER PUBLICATIONS

Li et al. "Analysis and Comparison of Nitrogen Compounds in Different Liquid Hydrocarbon Streams Derived from Petroleum and Coal" Energy&Fuels 2010, p. 5539-5547 (Year: 2010).*
(Continued)

*Primary Examiner* — In Suk C Bullock
*Assistant Examiner* — Alyssa L Cepluch
(74) *Attorney, Agent, or Firm* — SHELL USA, INC.

(57) ABSTRACT

The invention provides a method for pretreating a hydrocarbon steam cracker feed, comprising contacting the feed with a solvent to produce a pretreated feed having a reduced content of fouling components that cause fouling in the preheat, convection and radiant sections of the steam cracker and a rich solvent having an increased content of fouling components. The invention further provides a method for steam cracking hydrocarbons comprising: a) feeding a hydrocarbon steam cracker feed to the process; b) pretreating the feed by contacting the feed with a solvent to produce a pretreated feed having a reduced content of fouling components that cause fouling in the steam cracker and a rich solvent having an increased content of fouling components; c) heating the pretreated feed; and d) passing the pretreated
(Continued)

feed through a steam cracker under cracking conditions to produce cracked products.

9 Claims, 1 Drawing Sheet

(51) Int. Cl.

| | |
|---|---|
| ***C10G 21/14*** | (2006.01) |
| ***C10G 21/16*** | (2006.01) |
| ***C10G 21/20*** | (2006.01) |
| ***C10G 21/27*** | (2006.01) |
| ***C10G 55/04*** | (2006.01) |
| ***C10G 75/00*** | (2006.01) |

(52) U.S. Cl.
CPC ..... *C10G 21/16* (2013.01); *C10G 21/20* (2013.01); *C10G 21/27* (2013.01); *C10G 75/00* (2013.01); *C10G 2300/1003* (2013.01); *C10G 2300/202* (2013.01); *C10G 2300/308* (2013.01)

(56) References Cited

U.S. PATENT DOCUMENTS

| | | | | |
|---|---|---|---|---|
| 4,353,794 | A | 10/1982 | Winter, III et al. | |
| 4,764,256 | A | 8/1988 | Way | |
| 4,992,210 | A | 2/1991 | Naeger et al. | |
| 5,354,930 | A | 10/1994 | Atkins et al. | |
| 5,399,244 | A | 3/1995 | Gentry et al. | |
| 5,731,483 | A * | 3/1998 | Stabel | B29B 17/02 208/130 |
| 8,551,328 | B2 | 10/2013 | Maglio et al. | |
| 8,709,233 | B2 * | 4/2014 | McCoy | C10G 67/049 208/67 |
| 8,851,328 | B2 | 10/2014 | Schoeley et al. | |
| 8,961,780 | B1 | 2/2015 | Yusuf et al. | |
| 9,781,747 | B2 | 10/2017 | Kim et al. | |
| 9,839,897 | B2 | 12/2017 | Lacheen | |
| 10,927,315 | B2 | 2/2021 | Ramamurthy et al. | |
| 2002/0096451 | A1 | 7/2002 | Ackerson et al. | |
| 2008/0194900 | A1 | 8/2008 | Bhirud | |
| 2009/0107890 | A1 | 4/2009 | Hamad et al. | |
| 2010/0300932 | A1 | 12/2010 | Debuisschert et al. | |
| 2011/0155645 | A1 | 6/2011 | Serban et al. | |
| 2013/0153394 | A1 * | 6/2013 | Wieser-linhart | C10G 1/06 201/4 |
| 2013/0220884 | A1 * | 8/2013 | Bourane | C10G 55/04 208/57 |
| 2014/0005459 | A1 | 1/2014 | Zhan et al. | |
| 2014/0336427 | A1 * | 11/2014 | Baird | C10G 3/40 422/187 |
| 2016/0369184 | A1 * | 12/2016 | Ward | C10G 9/36 |
| 2018/0187087 | A1 | 7/2018 | Atkins et al. | |
| 2018/0355256 | A1 | 12/2018 | Dooley | |
| 2019/0062646 | A1 | 2/2019 | Hakeem et al. | |
| 2019/0161683 | A1 | 5/2019 | Narayanaswamy et al. | |
| 2019/0177626 | A1 * | 6/2019 | Ramamurthy | C10G 69/06 |
| 2020/0080009 | A1 | 3/2020 | Derks | |
| 2022/0135502 | A1 | 5/2022 | Vongachariya et al. | |

FOREIGN PATENT DOCUMENTS

| | | | | |
|---|---|---|---|---|
| CN | 103571537 | A | 2/2014 | |
| CN | 106833719 | A | 6/2017 | |
| EP | 0697455 | A2 | 2/1996 | |
| EP | 3907267 | A1 | 11/2021 | |
| GB | 1248814 | A * | 10/1971 | C10G 55/04 |
| GB | 1554767 | A | 10/1979 | |
| GB | 2040306 | A | 8/1980 | |
| JP | S4928642 | B1 | 7/1974 | |
| WO | 0046322 | A1 | 8/2000 | |
| WO | 2010070029 | A1 | 6/2010 | |
| WO | 2013002887 | A1 | 1/2013 | |
| WO | 2015000846 | A1 | 1/2015 | |
| WO | 2017093059 | A1 | 6/2017 | |
| WO | 2017167948 | A1 | 10/2017 | |
| WO | 2018025104 | A1 | 2/2018 | |
| WO | 2021110395 | A1 | 6/2021 | |

OTHER PUBLICATIONS

Muhammad et al. "Catalytic pyrolysis of waste plastic from electrical and electronic equipment" Journal of Analytical and Applied Pyrolysis 113 (2015) 332-339 (Year: 2015).*

Banerjee, Dwijen K.. Thermal Processing of Hydrocarbons—Petroleum to Petrochemicals—4.4.2 Furnace Design. PennWell. (2019). Retrieved from https://app.knovel.com/hotlink/pdf/id:kt0129FFY2/thermal-processing-hydrocarbons/furnace-design (Year: 2019).*

Saddiqui et al. "Pyrolysis of mixed plastics for the recovery of useful products" Fuel Processing Technology 90 (2009) 545-552 (Year: 2009).*

International Search Report and Written Opinion received for PCT Patent Application No. PCT/EP2017/081817 dated Feb. 19, 2018, 9 pages.

Xianglin et al. "China Refining Technology", Jul. 31, 2001, pp. 327-328.

Office Action Received for Application No. 201780075338.5, dated Apr. 26, 2021, 16 pages (8 pages of English Translation and 8 pages of Official Copy).

International Search Report and Written Opinion received for PCT Patent Application No. PCT/EP2020/060410, dated May 4, 2020, 09 pages.

International Search Report and Written Opinion received for PCT Patent Application No. PCT/EP2020/084802, dated Mar. 10, 2021, 10 pages.

International Search Report and Written Opinion received for PCT Patent Application No. PCT/US2020/043426, dated Aug. 28, 2020, 11 pages.

Office Action Received for Eurasian Application No. 202290394, dated Feb. 7, 2023, 4 Pages (2 Pages of English Translation and 2 Pages of Official Copy).

Office Action Received for Chinese Application No. 2020800289763, dated Aug. 1, 2022, 20 Pages(11 Pages of English Translation and 09 Pages of Official Copy).

Williams et al., "Fluidised Bed Pyrolysis of Low Density Polyethylene to Produce Petrochemical Feedstock", Journal of Analytical and Applied Pyrolysis, Jul. 1999, vol. 51, Issue No. 1-2, pp. 107-126.

Communication Pursuant to Rule 114(2) EPC Received for EP Application No. 20817002.7, dated Jan. 5, 2023, 5 Pages.

* cited by examiner

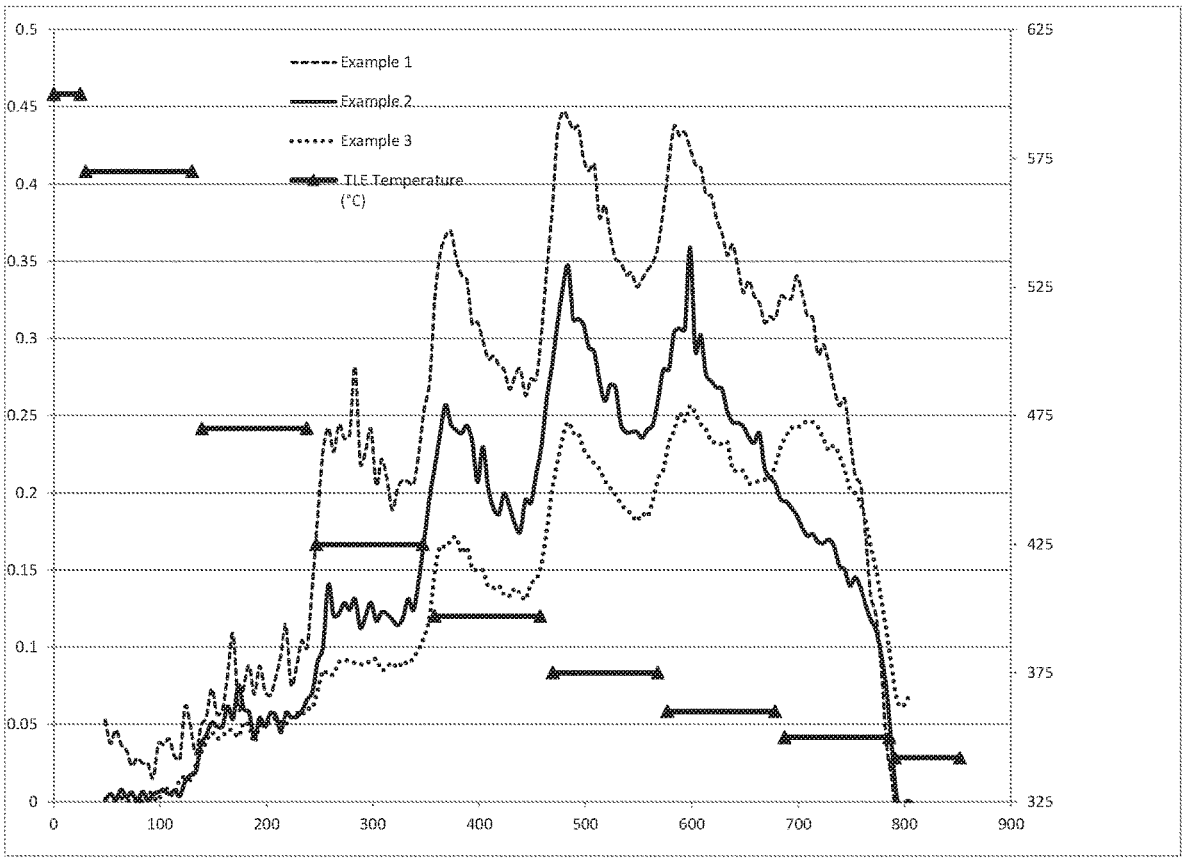
Example 1
Example 2
Example 3
TLE Temperature (°C)
0.5
0.45
0.4
0.35
0.3
0.25
0.2
0.15
0.1
0.05
0
625
575
525
475
425
375
325
0
100
200
300
400
500
600
700
800
900

METHOD OF PRETREATING AND CONVERTING HYDROCARBONS

CROSS REFERENCE TO RELATED APPLICATIONS

This is a national stage application of International Application No. PCT/EP2017/081817, filed 7 Dec. 2017, which claims benefit of priority to U.S. Provisional Application No. 62/431,458, filed 8 Dec. 2016.

FIELD OF THE INVENTION

The invention relates to a method of pretreating a hydrocarbon steam cracker feed and a method for steam cracking hydrocarbons.

BACKGROUND OF THE INVENTION

Conventionally, ethylene and propylene are produced via steam cracking of paraffinic feedstocks including ethane, propane, naphtha and hydrowax.

European patent application publication 0 697 455 describes the fouling of the transfer line exchangers that are used to rapidly cool the effluent from the steam cracker. This is a major factor determining the run length of the cracker. The fouling may be caused by the content of aromatic compounds in the feed, especially in feeds such as hydrowax, and the tars formed during pyrolysis in the cracking furnace.

US 2008/0194900 teaches a process for upgrading a naphtha stream by feeding the stream to a hydrotreater to remove impurities and then passing the stream to an aromatics extraction unit to produce a dearomatized naphtha stream. This dearomatized naphtha stream is then fed to a cracking process.

SUMMARY OF THE INVENTION

The invention provides a method for pretreating a hydrocarbon steam cracker feed, comprising contacting the feed with a solvent to produce a pretreated feed having a reduced content of fouling components that cause fouling in the preheat, convection and radiant sections of the steam cracker and a rich solvent having an increased content of fouling components.

The invention further provides a method for steam cracking hydrocarbons comprising: a) feeding a hydrocarbon steam cracker feed to the process; b) pretreating the feed by contacting the feed with a solvent to produce a pretreated feed having a reduced content of fouling components that cause fouling in the steam cracker and a rich solvent having an increased content of fouling components; c) heating the pretreated feed; and d) passing the pretreated feed through a steam cracker under cracking conditions to produce cracked products.

BRIEF DESCRIPTION OF THE FIGURES

The FIGURE depicts the coke layer formed in a laboratory scale transfer line exchanger.

DETAILED DESCRIPTION OF THE INVENTION

The invention provides a steam cracker feed with a higher hydrogen content which results in an improved product slate from the steam cracker. The amount of fouling in the downstream equipment, especially the transfer line exchangers (TLE) is reduced which results in longer run times without maintenance shutdowns, and improved heat transfer in the exchangers. It is believed that an additional advantage would be that the remaining liquid from the extraction can be used to reduce viscosity in the quench oil section.

The invention provides a method for pretreating a hydrocarbon steam cracker feed. The hydrocarbon stream cracker feed comprises one or more hydrocarbons, preferably paraffinic hydrocarbons. The feedstock may comprise non-paraffinic hydrocarbons such as olefins, preferably in quantities of less than 10 wt % based on the total weight of hydrocarbons. The feed may additionally comprise a recycle stream from the process.

In one embodiment, the hydrocarbon steam cracker feed may comprise hydrowax, hydrotreated vacuum gasoil, gasoil, slackwax or mixtures thereof. Hydrowax is a hydrogenated residue produced by hydrocracking of vacuum flashed distillate streams. Slackwax is a paraffin stream obtained from a dewaxing unit that is used in the production of lubricants and paraffins.

In another embodiment, the hydrocarbon steam cracker feed may comprise pyrolysis oil from plastic waste. This stream has a large concentration of contaminants making it a very low value stream.

The hydrocarbon steam cracker feed also comprises fouling components that cause fouling in the downstream sections of the steam cracker. This fouling may occur in the preheat, convection and/or radiant sections of the cracker or it may form in downstream heat exchange and/or separation equipment. These fouling components may include any component that will cause coking or fouling in the equipment. These fouling components may condense in the transfer line exchangers when the products from the steam cracker are cooled. Examples of these fouling components include polycyclic aromatics, resins and mixtures thereof.

The hydrocarbon steam cracker feed may also comprise contaminants that cause issues in the cracked products workup section. These contaminants may include nitrogen, vanadium, chlorine, oxygen, sulfur or compounds thereof. These contaminants may also be removed from the hydrocarbon steam cracker feed by contact with the solvent.

The hydrocarbon steam cracker feed is pretreated by contacting the feed with a solvent. The feed may be contacted with the solvent in a vessel, in a conduit or in another means known to one of ordinary skill in the art for carrying out a solvent extraction step.

Examples of suitable solvents for performing the pretreatment include furfural, sulfolane, toluene, N-formyl morpholine, N-methylpyrrolidone, tetra-ethylene glycol and dimethylsulfoxide.

In one embodiment, the fouling components may be removed from the rich solvent. These fouling components may be used in another part of the steam cracker system as a quench oil stream. The fouling components may also be used to reduce the viscosity of a heavy pitch and/or cracked gasoil stream.

After contacting the hydrocarbon steam cracker feed with the solvent, the pretreated feed has a reduced content of fouling components. The pretreated feed has a higher hydrogen content than the hydrocarbon steam cracker feed before it is contacted with the solvent. The rich solvent has an increased content of fouling components.

After contacting with the solvent, the pretreated feed preferably has 75% or less of the amount of fouling components in the hydrocarbon steam cracker feed, more preferably 60% or less and most preferably 50% or less of the fouling components in the hydrocarbon steam cracker feed.

The pretreated feed is typically preheated. The feed can be heated using heat exchangers, a furnace or any other combination of heat transfer and/or heating devices.

The pretreated feedstock is steam cracked in a cracking zone under cracking conditions to produce at least olefins and hydrogen. The cracking zone may comprise any cracking system known in that art that is suitable for cracking the pretreated feedstock. The cracking zone may comprise one or more furnaces, each dedicated for a specific feed or fraction of the feed.

The cracking step is performed at elevated temperatures, preferably in the range of from 650 to 1000° C., more preferably of from 750 to 850° C. Steam is usually added to the cracking zone, acting as a diluent to reduce the hydrocarbon partial pressure and thereby enhance the olefin yield. Steam also reduces the formation and deposition of carbonaceous material or coke in the cracking zone. The cracking occurs in the absence of oxygen. The residence time at the cracking conditions is very short, typically on the order of milliseconds.

From the cracker, a cracker effluent is obtained that may comprise aromatics, olefins, hydrogen, water, carbon dioxide and other hydrocarbon compounds. The specific products obtained depend on the composition of the feed, the hydrocarbon-to-steam ratio, and the cracking temperature and furnace residence time. The cracked products from the steam cracker are then passed through one or more heat exchangers, often referred to as TLEs, to rapidly reduce the temperature of the cracked products. The TLE's preferably cool the cracked products to a temperature in the range of from 400 to 550° C.

EXAMPLES

The following examples were carried out in a bench scale steam cracker unit. A pump feeds hydrocarbon from a temperature-controlled feed vessel to an evaporator. The hydrocarbon stream is mixed with a gaseous inert stream and the mixture is heated to a temperature between 380 and 550° C. The feed is vaporized at this temperature, and it is then fed into a coil/reactor at temperatures typically in the range of from 700 to 850° C.

A products stream is removed from the coil/reactor and cooled in a transfer line exchanger (TLE) from a temperature of about 600° C. to a temperature of about 300-350° C. Fouling components condense on the walls of the TLE and may thermally decompose into a coke layer.

The gas stream from the TLE is further cooled to about 40° C. in a separate quench vessel and this stream can then be analyzed.

The thickness of the coke layer on the wall can be calculated by measuring the wall thickness of the empty tube and the wall thickness of the fouled tube and subtracting the empty tube thickness.

Examples

Three examples were carried out by cracking a sample in the equipment described above. Various characteristics of the sample before it was cracked are shown in Table 1, and the coke layer formed in the TLE downstream of the cracker are shown for each example in the FIGURE.

In Example 1, a hydrowax was cracked.

In Example 2, the same hydrowax as in Example 1 was first contacted with furfural to extract at least a portion of the fouling components and was then cracked.

In Example 3, the same hydrowax from Example 1 was contacted with furfural to extract at least a portion of the fouling components. This extraction step was repeated two additional times (for a total of three extractions). This hydrowax was then cracked.

TABLE 1

| Characteristic (as measured at 70° C.) | Example 1 | Example 2 | Example 3 |
|---|---|---|---|
| Density (kg/l) | 0.8188 | 0.815 | 0.812 |
| Refractive Index | 1.4548 | 1.4514 | 1.4500 |
| Hydrogen content (wt %) | 13.82 | 13.92 | 14.05 |
| Sulphur (wt %) | 0.003 | 0.0023 | 0.0017 |

That which is claimed is:

1. A method of pretreating a hydrocarbon steam cracker feed, the hydrocarbon steam cracker feed comprising pyrolysis oil from plastic waste and at least one contaminant, the contaminant comprising nitrogen, oxygen, or compounds thereof, the hydrocarbon steam cracker feed further comprising paraffinic hydrocarbons and olefins, the method comprising contacting the feed with a solvent to produce a pretreated feed having a reduced content of fouling components, a reduced content of the at least one contaminant, and a rich solvent having an increased content of the fouling components and the at least one contaminant;

wherein the fouling components comprise polycyclic aromatics, resins, or a mixture thereof and cause fouling in preheat, convection and radiant sections of a steam cracker;

wherein the solvent is selected from the group consisting of furfural, sulfolane, toluene, N-formyl morpholine, N-methylpyrrolidone, tetraethylene glycol, and dimethylsulfoxide.

2. The method of claim 1 wherein the pretreated feed has a higher hydrogen content than the hydrocarbon steam cracker feed.

3. The method of claim 1 wherein the fouling components cause fouling by condensing in transfer line exchangers.

4. The method of claim 1 further comprising removing the fouling components from the rich solvent and using those components in another part of a steam cracker system as a quench oil stream or to reduce the viscosity of a heavy pitch and/or cracked gasoil stream.

5. A process for steam cracking hydrocarbons comprising:

a. Feeding a hydrocarbon steam cracker feed comprising pyrolysis oil from plastic waste and at least one contaminant, the contaminant comprising nitrogen, oxygen, or compounds thereof, the hydrocarbon steam cracker feed further comprising paraffinic hydrocarbons and olefins, to the process;

b. Pretreating the feed by contacting the feed with a solvent to produce a pretreated feed having a reduced content of the contaminants comprising nitrogen, oxygen, or compounds thereof and a reduced content of fouling components that cause fouling in preheat, convection and radiant sections of a steam cracker and a rich solvent having an increased content of fouling components and the at least one contaminant;

c. Heating the pretreated feed; and d. Passing the pretreated feed through the steam cracker under cracking conditions to produce cracked products;

wherein the fouling components comprise polycyclic aromatics, resins, or a mixture thereof; and wherein the solvent is selected from the group consisting of furfural, sulfolane, toluene, N-formyl morpholine, N-methylpyrrolidone, tetraethylene glycol, and dimethylsulfoxide.

6. The process of claim 5 further comprising passing the cracked products through one or more heat exchangers to reduce a temperature of the cracked products.

7. The process of claim 5 wherein the cracking conditions comprise a temperature in a range of from 700 to 900° C.

8. The method of claim 1 wherein the quantity of non-paraffinic hydrocarbons is less than 10 wt % based on the total weight of hydrocarbons.

9. The process of claim 5 wherein the quantity of non-paraffinic hydrocarbons is less than 10 wt % based on the total weight of hydrocarbons.

* * * * *